United States Patent [19]

Sheppard et al.

[11] Patent Number: 4,497,608

[45] Date of Patent: Feb. 5, 1985

[54] MONUMENT FOUNDATION DIGGER

[75] Inventors: Roy J. P. Sheppard; Howard S. Thornhill; Mark S. Francis, all of Willowdale, Canada

[73] Assignee: The Trustees of The Toronto General Burying Grounds, Toronto, Canada

[21] Appl. No.: 503,661

[22] Filed: Jun. 13, 1983

[51] Int. Cl.[3] ..... E02F 3/44; E02F 3/81

[52] U.S. Cl. ..... 414/726; 414/624; 414/626; 414/739; 294/70; 294/115; 37/183 R; 37/188; 37/DIG. 6

[58] Field of Search ..... 414/565, 624, 626, 621, 414/685, 686, 687, 688, 695.5, 722, 723, 726, 739, 607; 37/183 R, 184, 185, 186, 188, DIG. 6; 294/70, 115, 88

[56] References Cited

U.S. PATENT DOCUMENTS

| | | | |
|---|---|---|---|
| 358,075 | 2/1887 | Schofield | 294/70 X |
| 994,506 | 6/1911 | Falcone | 414/739 X |
| 2,120,326 | 6/1938 | Doerschlen | 294/70 X |
| 2,689,661 | 9/1954 | Przybylski | 214/147 |
| 2,731,163 | 1/1956 | Wills et al. | 214/147 |
| 2,754,977 | 7/1956 | Przybylski | 212/67 |
| 2,770,057 | 11/1956 | Camp | 37/103 |
| 2,837,846 | 6/1958 | Long | 37/186 |
| 3,344,539 | 10/1967 | Crum | 37/103 |
| 3,462,029 | 8/1969 | Mork | 37/183 R X |
| 3,750,311 | 8/1973 | Anderson | 37/188 |
| 3,881,263 | 5/1975 | Coeurderoy | 37/186 |
| 3,896,950 | 7/1975 | McCain | 37/183 R X |
| 3,914,886 | 10/1975 | Berg et al. | 37/188 X |
| 4,056,154 | 11/1977 | Tamaro | 175/416 |
| 4,059,886 | 11/1977 | Bricon | 37/183 R X |
| 4,063,374 | 12/1977 | Washington | 37/142.5 |
| 4,239,273 | 12/1980 | Dodemont et al. | 37/186 X |
| 4,315,375 | 2/1982 | Shinn | 37/118 R |
| 4,318,663 | 3/1982 | Waite | 414/707 |
| 4,392,774 | 7/1983 | Thomas, Jr. | 414/726 |

*Primary Examiner*—Leslie J. Paperner
*Assistant Examiner*—Lyle Kim
*Attorney, Agent, or Firm*—Ridout & Maybee

[57] ABSTRACT

A digger for digging out substantially vertically-sided holes e.g. for gravestone monument foundations, is in the form of an attachment adapted to be connected on the dipper stick of a backhoe machine. The attachment has a downwardly-depending digger frame pivoted at its upper end to an attachment frame which is connected to the free end of the dipper stick. A vertically extending operating shaft extends upwardly relative to the digger frame and is connected through a pair of lower linkages to the sections of a clam shell bucket mounted on the lower end of the digger frame. The upper end of the operating shaft connects through a connecting link and a rocking lever to the piston of the dipper stick piston and cylinder arrangement.

15 Claims, 4 Drawing Figures

MONUMENT FOUNDATION DIGGER

The present invention relates to a digger attachment, more particularly intended for use in digging out neat rectangular holes with substantially vertical sides. In modern cemetery management, it is considered good practice to provide a firm foundation to gravestones or monuments to be erected ajacent burial plots, in order to reduce or prevent the occurrence of tilting or toppling of the monuments. Such foundation is commonly provided in the form of a raft of concrete which provides a stable base on which the monument may be erected. For the purpose of digging out the foundation prior to pouring the conrete, it is desired to provide a neat rectangular hole with substantially vertical sides without unduly disturbing the surrounding ground.

Continuous conveying-type digger machines are known which may be used for digging out a monument foundation, but these do not work well on hard or stony ground or in heavy clay-type soils, and the machines are prone to frequent breakdown. Post-hole auger-type devices are more reliable, but tend to be somewhat slow, as a row of holes needs to be dug out. The applicant is aware of various other prior proposals for digger devices capable of digging out a hole with vertical sides, but all these have been relatively complicated and expensive forms of apparatus.

The present invention provides a relatively simple device capable of excavating substantially vertically-sided holes with improved speed and reliability and which is adapted to be employed as an attachment on the dipper stick of a conventional backhoe machine. More especially, the device is adapted to be attached to the dipper stick of the backhoe in place of the conventional tiltable backhoe bucket. The attachment device comprises an attachment frame which is securable to the free end of the dipper stick, and an elongated digger frame pivotally connected to the attachment frame and adapted to hang in downward dependence therefrom. At the lower end of the digger frame is provided a clam shell bucket with two shell sections. Each shell section has a point of pivotal connection to a lower region of the digger frame. Thus, the shell sections can swing between a closed position in which the shell sections are mutually adjacent one another, and an open position, in which the shells are spread apart. An operating shaft extends longitudinally of the digger frame, and a connecting link is pivotally connected at its upper end and connects pivotally to a rocking lever which is itself pivotally connected on the attachment frame. In use, the rocking lever is connected to the piston conventionally provided on the dipper stick and which, in the conventional device, serves to tilt the bucket of the backhoe. Thus, extension and retraction of the backhoe piston can rock the rocking lever rearwardly and forwardly, thereby driving the connecting link and the operating shaft downwardly and upwardly. Each shell section has an operating link which at one end is pivotally connected to the shell section and, at its opposite end, is pivotally connected to the operating shaft, so that the upward and downward movement of the operating shaft swings the shell sections between their above-referred to open and closed positions.

In use, when the above attachment is connected on the dipper stick of a backhoe machine, it can readily be used to dig out neat rectangular areas by positioning the digger attachment a few inches above the ground surface to be dug out, using the conventional backhoe machine controls, and permitting the device to drop downwardly under its own substantial weight, thus permitting the clam shell sections, which are maintained in an open position, to bite into the ground surface. The dipper stick may be rotated downwardly to drive the clam shell sections substantially vertically downwardly. The clam shell sections are then closed together by operating the dipper stick piston and cylinder arrangement, so that the clam shells scoop up a quantity of earth. The device is raised and pivoted to one side and the clam shell sections opened to permit the scooped-up earth to be deposited, following which the digging operation can be repeated as many times as are necessary in order to dig out a hole of the required depth.

The device is of relatively simple construction and is relatively inexpensive to manufacture, and makes use of the existing hydraulic cylinder and piston arrangements on the backhoe machine for positioning the device and in carrying out its digging functions, without requiring any complicated or time-consuming modifications of the backhoe machine.

In the preferred form, described in more detail hereinafter, the operating links and pivotal connections mentioned above are arranged in a manner such that the attachment is stabilized against reaction to the movement of the dipper stick piston tending to impart a tilting moment to the attachment.

Further advantages of the present arrangement will become apparent from consideration of the following detailed description of a preferred embodiment with reference to the accompanying drawings, in which.

Figure 1:
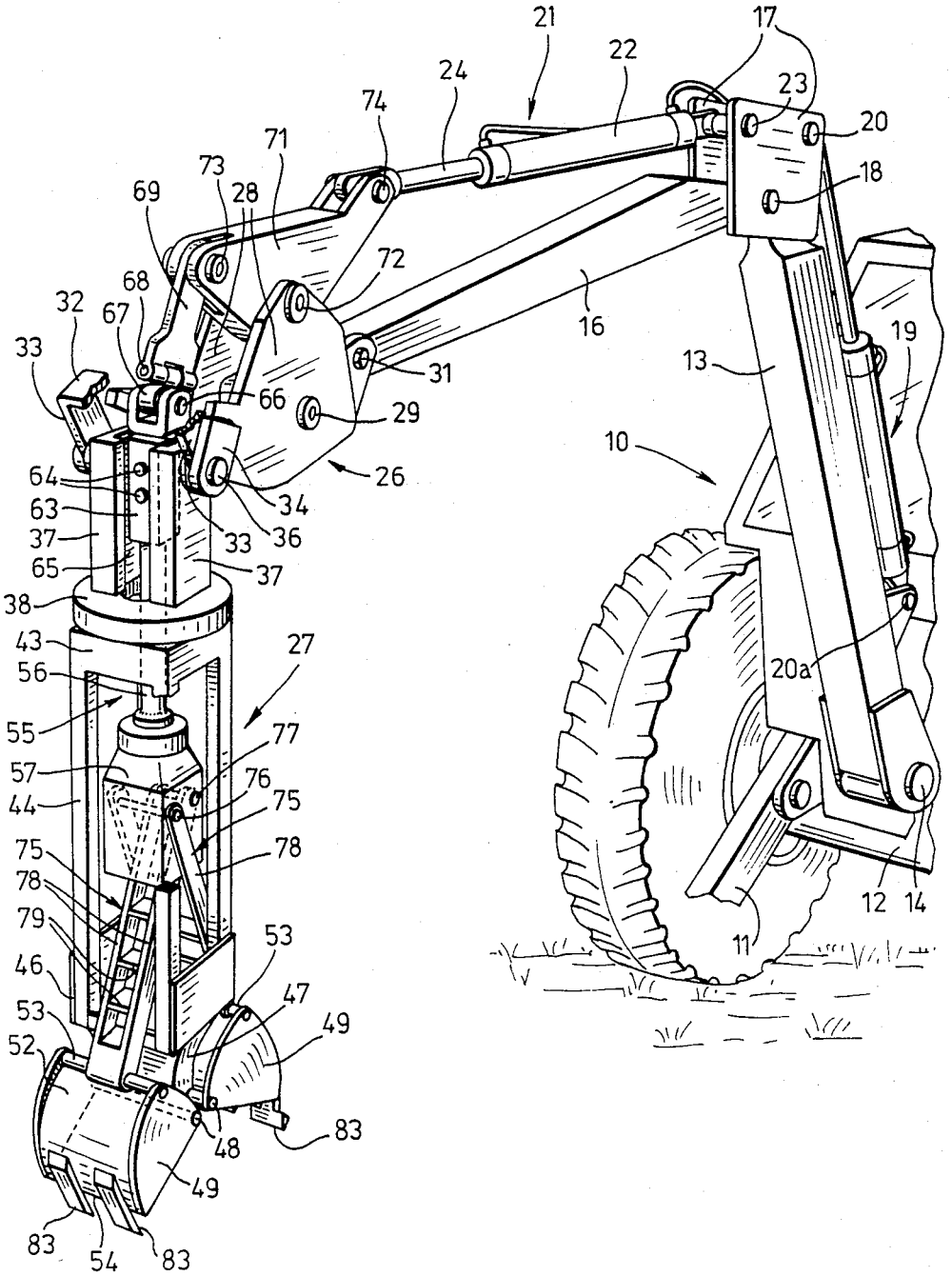
FIG. 1 shows a perspective view of one form of attachment in accordance with the invention attached to a conventional form of backhoe machine with portions cut away to reveal interior detail.

Referring to the drawings, a wheeled backhoe machine 10 has stabilizer ground-engaging legs 11 connected to its chassis 12. A boom 13 is pivoted at a horizontal pivot axis 14 and is connected to the chassis 12 through a conventional arrangement of supporting links and hydraulic cylinders such that the boom 13 can be elevated and lowered or rotated from side to side about a vertical axis relative to the chassis 12. A dipper stick 16, to which are rigidly connected a pair of parallel plates 17, is pivotally mounted at 18 on the boom 13. A further hydraulic piston-cylinder arrangement 19 (shown somewhat schematically in FIG. 1) connects between a pivot point 20 on the plates 17 and a pivot point 20*a* on the boom 13, whereby on extension and retraction of the piston of the arrangement 19 relative to its cylinder, the dipper stick 16 together with the plates 17 can be rocked upwardly and downwardly relative to the boom 13 about the pivot point 18. A dipper stick piston and cylinder arrangement 21 is connected on the dipper stick 16 and comprises a cylinder 22 pivotally connected at 23 to the plates 17 and a piston 24.

Mounted on the free end of the dipper stick 16 is a digger attachment comprising an attachment frame 26 and a digger frame 27. The attachment frame 26 comprises two generally parallel side plates 28 each having a forward fastening opening and a rearward fastening opening. A threaded fastener device 29 is passed through the forward openings and a threaded fastener device 31 through the rearward fastening openings. The fastener devices are well tightened up to clamp the attachment plates 28 securely on each side of the dipper stick. The forward fastener device 29 passes through a forward aperture in the dipper stick 16 which aperture, in the conventional backhoe device provides a pivot axis for the backhoe bucket, while the rearward fastener 31 passes through an aperture which, in the dipper stick 16 in the conventional device, provides a pivotal support for a link connected to the piston 24 and to a driving link which is also pivoted to the backhoe bucket. The apertures in the plates 28 which receive the fastener devices 29 and 31 may be provided with replaceable bushings so that the present arrangement may be fitted to the dipper sticks of various types of backhoe machine having forward and rearward fastener apertures of varying sizes employing fastener members 29 and 31 of different diameters.

Figure 2:
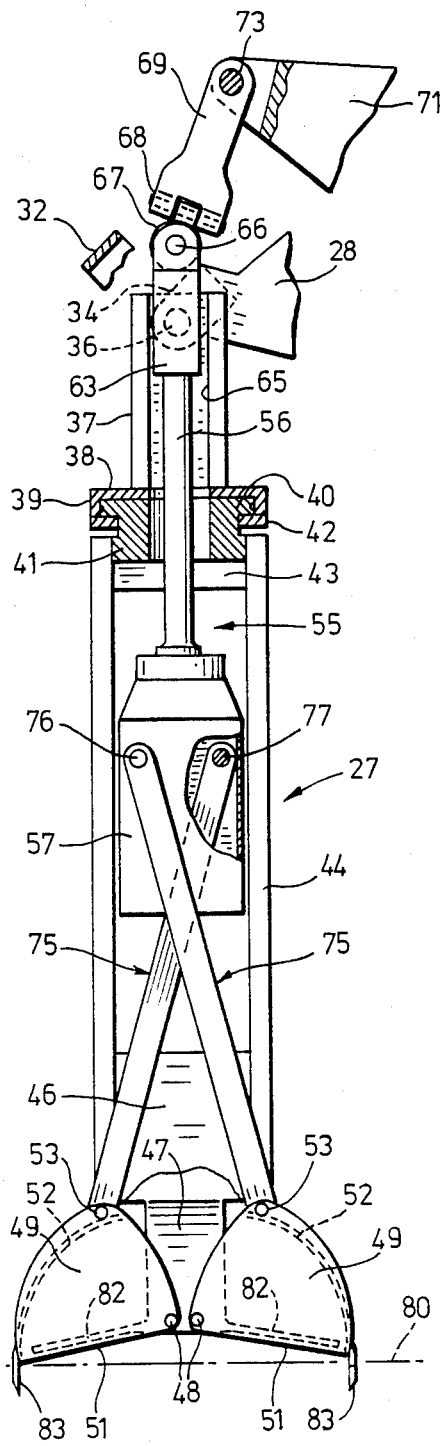
FIG. 2 shows a partial vertical section of the attachment, with portions cut away to reveal interior detail.
Figure 3:
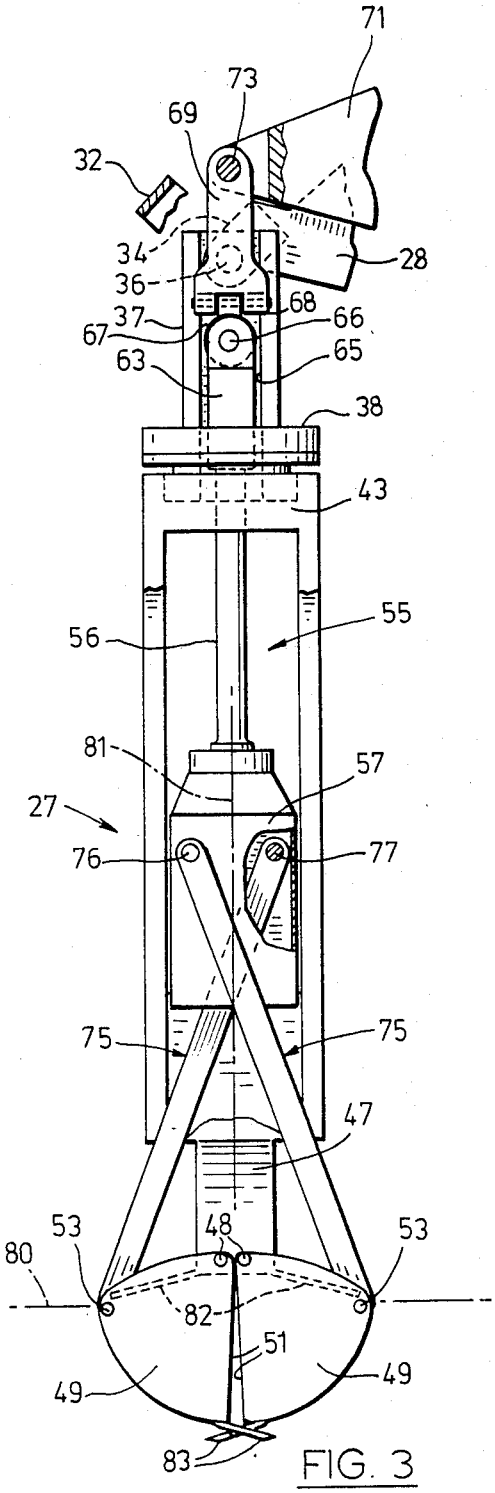
FIG. 3 shows a view corresponding to FIG. 2, but with the clam shells in closed position.

In order to maintain the forward ends of the plates 28 at a predetermined spacing, a yoke-like cross-brace is provided comprising a cross piece 32 (shown partly broken away in FIG. 1) having at each end a downwardly depending leg 33. Each leg 33 is joined, e.g. by welding, to the adjoining portion of the plate 28. Also at the forward end of each plate 28, and on its outer side, is connected, e.g. by welding, a generally D-shaped reinforcing socket plate 34. Through each socket plate 34 and through the adjacent portion of the plate 28 is passed a stub shaft 36. The shafts 36 on opposite sides of the dipper stick 16 are coaxial with one another, and define a horizontal axis about which the digger frame 27 pivots in a vertical plane. The digger frame 27 has an upper section consisting of two parallel cheek pieces 37, each rigidly connecting e.g. by welding, at its lower end, to the upper side of an annular support plate 38. The stub shafts 36 each have an inner end received in a socket in the outer face of the adjoining cheek piece 37. As may best be seen in FIG. 2, the support plate 38 has a downwardly extending wall 39 defining a circular recess in which is received an annular upper portion 40 of a bearing block 41. The lower face of the portion 40 bears on the upper side of an annular bearing plate 42 supported at its perimeter on the wall 39 by vertically extending fasteners (not shown) passing through the plate 42 and received in the wall 39. The annular portion 40 is a rotatable fit within the cavity defined between the plates 38 and 42 and the wall 39, so that the block 41 may swivel about a vertical axis relative to the bearing member 38 and the cheek pieces 37. The swivel arrangement may be lubricated by heavy grease introduced through a grease nipple 39*a* shown in FIG. 4. The lower portion of the block 41 is rigidly connected, e.g. by welding, to a rectangular framework having a square upper frame portion 43 receiving the block 41, downwardly extending bar portions 44, and a rigid square section lower frame 46. Rigidly connected to the lower frame 46 is a downwardly extending plinth-like support 47. A pair of parallel pivot pins 48 pass through the plinth 47 at its lower end, and to each pin 48 is pivoted a clam shell section 49. Each shell section 49 has on its lower face a lip 51 bordering an open mouth of the shell section, and an arcuate outer wall 52 extending upwardly from the side opposite the pivot pin 48 to an upper pivot pin 53. The lower side or lip section 54 of the arcuate wall 52 extends generally parallel to the pins 48 and 53. It may be noted that the shell sections 49 may swing about the lower pivot pins 48 between relatively open and relatively closed positions, as shown in FIGS. 2 and 3, respectively.

Figure 4:
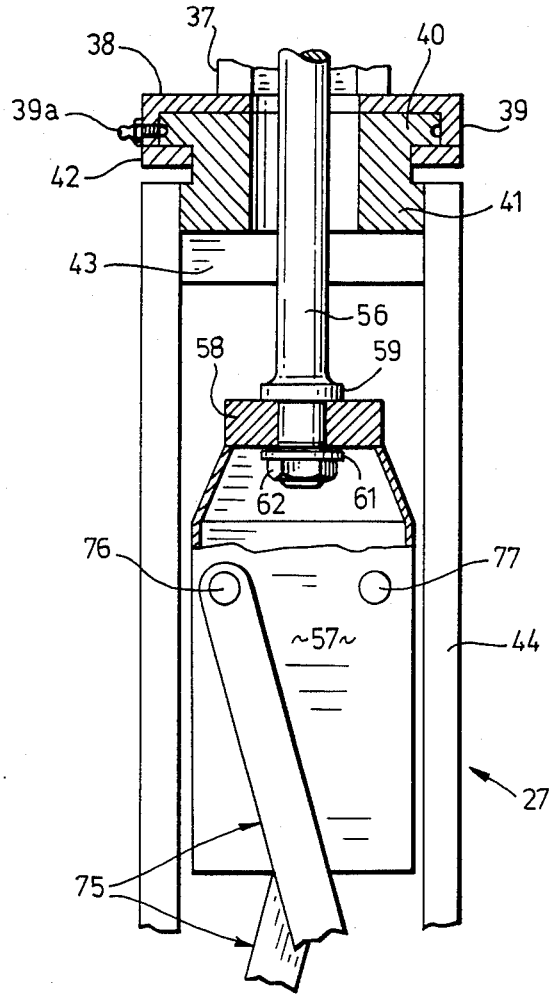
FIG. 4 shows a side view, partly in section, and on an enlarged scale, of the attachment device, illustrating its swivel connections.

An operating shaft 55 extends generally vertically with respect to the digger frame 27. The shaft 55 comprises an upper shaft portion 56 and a lower, hollow, generally rectangular housing portion 57 as seen in FIG. 4. The housing 57 comprises an annular upper portion 58, which receives a lower end of the shaft 56. An annular collar 59 is welded on the shaft 56 and abuts the upper side of the portion 58. The lower end of the shaft 56 extending below the lower surface of the portion 58 is threaded, and carries a washer 61 and nut 62, thus linking the shaft 56 and the housing 57 together but permitting the one to swivel about the other about a vertical axis. For ease of assembly and maintenance of the structure, one or more of the vertical plate portions constituting the sides of the housing 57 is or are removable, being connected to the remainder of the housing structure by mechanical fasteners e.g. bolts. A connecting member 63 is bolted on the upper end of the shaft 56 with bolts 64. In the preferred form, as shown, the connecting member 63, and hence also the shaft 55 is guided to move linearly and longitudinally relative to the digger frame 27. The inner side of each check piece 37 is formed with a vertically extending channel or recess 65 in which the adjacent side of the member 63 is received, with a small transverse clearance, so that transverse or horizontal movement of member 63 relative to the pieces 37 is limited. The member 63 supports a pivot pin 66 on which rotates a bearing member 67 of a universal joint comprising a further pivot pin 68 arranged at right angles to pin 66. A connecting link 69 is connected pivotably to the pin 68 of the universal joint.

A rocking lever in the form of a triangular block 71 is supported on the attachment frame 26 through a pivot pin 72 passing through the upper portion of each attachment plate 28, and defining a pivotal axis for the block 71 parallel to the axis of the stub-shafts 36. At the end adjacent the digger frame 27, the block 71 is connected through a pivot pin 73 to the connecting link 69, and, at the opposite end is pivotally connected through a pivot pin 74 to the piston 24 of the dipper stick piston and cylinder arrangement 21. With this arrangement, when the piston 24 is extended or retracted, the rocking link 71 and connecting link 69 are rocked forwardly and rearwardly, thus driving the operating shaft 54 downwardly and upwardly.

A rigid rectangular operating link 75 connects the upper pivot pin 53 of each clam shell section 49 and the housing 57. The upper ends of these operating links consist of a pair of pivot pins 76 and 77 which are parallel to the upper pivot pins 53. Adjacent each of its outer ends, each of the pivot pins 76 and 77 is journalled in the side wall of the housing 57. Each rigid operating link 75 further comprises a pair of spaced parallel links 78. The links 78 are braced and interconnected by a series of parallel rung-like cross-pieces 79, which are rigidly connected at each end to the links 78.

It may be noted that in the preferred form, as shown, the upper pivot pins 76 and 77 of the links 75 are disposed laterally of, and on opposite sides of, an imaginary median line or axis (indicated by reference numeral 81 in FIG. 3) running from the pivotal connection 66 between the operating shaft 54 and the connecting link 69 and the lower region of the digger frame 27 at which the shell sections 49 are pivotally connected at the lower pivot points 48 or at the mid-point between points 48. Further, in the preferred form, as shown, the links 75 cross over one another intermediate their length. To permit this, one of the operating links (that connected to the pivot pin 77) is that of a lesser width, and passes freely within the other link (that connected to the pivot pin 76) and is connected to the pin 77 within the housing 57, while the other link is connected to the pivot pin 76 on the outer side of the housing, as is best seen in FIG. 1.

It will be appreciated, therefore, that with the above linkage arrangement, as the operating shaft is drawn upwardly, as shown in FIG. 2, the clam shell sections 49 are rotated toward their open position, as shown in FIG. 2, while when the shaft 54 is driven downwardly, the shell sections are moved to their closed position, as indicated in FIG. 3.

In use, the backhoe operator manipulates the conventional backhoe machine controls, with the piston 24 in a retracted condition and the shell sections 49 open, to position the dipper stick 16 so that the clam shell sections 49 on the digger frame 27 are suspended a few inches, e.g. 5 or 6 inches, above the ground surface to be excavated. The assistance of a further operative standing adjacent the digger frame may be required to give verbal instructions to the backhoe operator to facilitate the precise positioning of the digger device. At this point, a predetermined condition of retraction of the boom piston (not shown) connected to the pivot point 20 on the dipper stick plates 17 determines the angle of the dipper stick 16 relative to the boom 13. The operator then releases the pressure in the cylinder of the cylinder and piston arrangement 19 associated with the boom 13, thus permitting the dipper stick 16, together with the attachment frame 26 and the digger frame 27 to drop bodily downwardly. Because of the relatively massive weight of the dipper stick 16, the attachment frame 26, and the digger frame 27, the momentum of these parts causes the horizontal lip 54 at the outer side of each clam shell section 49 to bite downwardly into the soil surface 80, as shown in FIG. 2. The piston of the boom piston at cylinder arrangement 19 is then extended to rotate the dipper stick 16 downward and cause the open clam shell sections 49 to penetrate substantially vertically downwardly into the ground, the depth of entry being typically 5 or 6 inches, in normal soil. Because of the large radius of the arc of movement of the digger frame 27, and the relatively small distance of travel in the arc, the deviation of the line of travel of the excavating lip 54 of the shell sections 49 from the vertical is negligible.

The operator then uses the conventional backhoe machine controls to extend the piston 24 to rock the lever 71 downwardly, and drive the operating shaft 54 downwardly to close the clam shell sections 49 as shown in FIG. 3, thus scooping up a quantity of earth within the sections 49. The dipper stick together with the digger attachment can then be raised, and swung to one side, using the conventional backhoe machine controls, and the piston 24 retracted, to swing the clam shell sections 49 to the open positions (FIG. 2), so that the earth trapped between these sections is released.

The backhoe operator can then re-position the digger attachment with the clam shells in the open position within or slightly above the hole which has now been dug out, and the above-described digging operation can be repeated until an excavation of the required depth has been accomplished. With the arrangement shown in the drawings a deep foundation for a monument e.g. to a depth as great as about 6 feet, may be excavated in less than about 15 minutes.

In the preferred form, as shown, the plinth section 47 is provided with a pair of outwardly and downwardly-inclining ejector plates 82 which, as may readily be appreciated from consideration of FIGS. 2 and 3, assist in ejecting the earth from between the shell sections 49 as these are rotated from the relatively closed position, (FIG. 3) to the open position (FIG. 2).

One advantage of the preferred arrangement of linkages as shown is that it confers increased stability on the structure during extension of the piston 24 to effect closing movement of the clam shell sections. On downward rotation of the connecting link 69 from the position shown in FIG. 2 to the position shown in FIG. 3, a component of force directed horizontally outwardly away from the dipper stick 16 is exerted on the upper end of the operating shaft 55. At this point in the digging operation, however, at least the tips of the clam shell sections 49 are each anchored firmly in the ground, so that asymmetric movement of the links 75 is resisted, and thus the lateral spacing of the pivot points 76 and 77 on opposite sides of the median or axis 81, tends to resist any tilting movement of the operating shaft 54 away from the vertical. As noted above, the engagement of the connecting member 63 within the channels 65 in the check pieces 37 limits horizontal or transverse displacement of the shaft 55 relative to the digger frame 27. Owing to the preferred arrangement of linkages the reaction forces exerted between the member 63 and the pieces 37 are not large, and thus frictional forces tending to produce wear are reduced. A heavy lubricant grease may of course be used between the channels 65 and the member 63. Firmer anchoring of the clam shell sections 49 relative to the ground, tending to enhance the above-described stabilizing effect, is obtained when the lip sections 54 are provided in the preferred form with downwardly directed teeth 83 as shown, the points of which exert a high impact pressure on the ground during the downward free fall of the digger frame relative to the boom 13, so that these teeth 83 tend to be deeply anchored in the ground at the time movement of the sections 49 to their closed position is commenced. To facilitate forming the excavation with vertical sides, these teeth 83 desirably have outer surfaces which conform to a plane substantially tangential to the arcuate outer face of the arcuate shell side sections 52. Desirably also, the above-described linkages are arranged so that at the normal limit of retraction of the piston 24 into its cylinder 22, the shell sections 49 are rotated to a position in which the outer faces of the teeth 83 are substantially vertical.

FIG. 1 shows the arrangement in which the rectangular area dug out by the shell sections 49 approximately parallel to the dipper stick 16. As will be appreciated, because the lower section of the digger frame 27 is rotatable about the vertical swivel connection 40, 42 together with the housing 57 which is swivelable about the connection 58, 61, the attachment may be orientated at right angles to the direction shown in FIG. 1, or at any angle in between, to dig out a rectangle extending transversely with respect to the dipper stick 16. In the latter condition, the above-referred to tilting movement is again resisted by the embedding of the lip portions of the shell sections 49 or by the teeth 83 in the ground. As will be appreciated, the pivot pins 48, 53, 76 and 77, which confine rotation of the sections 49, and of the links 75, to rotation about mutually-parallel axes extending transversely of the digger frame 27, together with the rigid rectangular links 75, form sets of rigid parrallelogram linkages which tend to resist any moment tilting the operating shaft 54, out of the vertical.

The preferred arrangement as shown in which the links 75 cross over one another intermediate their lengths permits relatively wide lateral spacing between the pivot pins 76 and 77 while maintaining a laterally relatively compact linkage arrangement.

The provision of a universal joint 67, 68 between the upper operating shaft section 56 and the rocking lever 71 permits some freedom of sideways movement of the shaft 56 relative to the dipper stick 16 and the lever 71, thus allowing for some degree of sideways waggle of the shaft 56 without risk of an excessive strain being applied to the pivotal connections.

It will be appreciated that the arrangement illustrated in the drawings may be readily attached to the dipper stick of the conventional backhoe machine, it being merely necessary to remove the pivot pins and linkages supporting the conventional backhoe bucket on the dipper stick 16 and to uncouple the dipper stick piston 24 from the backhoe bucket linkage before attaching the attachment frame 26 to the dipper stick with the above-mentioned fasteners 29 and 31 and then connecting the piston 24 to the lever 71 with a pivotal fastener pin such as the pin 74.

In the preferred arrangement, in order to provide a more compact linkage structure, the rocking lever 71 is connected as illustrated to the attachment plates 28 at an intermediate point 72, to the connecting link 69 at a point 73 adjacent the digger frame 27, and to the piston 24 at a point 74 on the end of the lever 71 adjacent the piston 24.

We claim:

1. A digger attachment for the dipper stick of a backhoe comprising an attachment frame adapted to be secured to the free end of the dipper stick, an elongated digger frame pivotally connected to the attachment frame and depending downwardly therefrom, a clam shell bucket at the lower end of the digger frame and having two shell sections each having a point of pivotal connection to a lower region of the digger frame about which the sections can swing between a closed position with the shell sections mutually adjacent and an open position with the shells spread apart, an operating shaft extending longitudinally of the digger frame, a connecting link pivotally connected to the operating shaft adjacent an upper end thereof, a rocking lever pivotally connected to the connecting link and to the attachment frame and having a coupling point for coupling with a piston of a cylinder and piston arrangement provided on the dipper stick, whereby rocking motion of the rocking lever alternately drives the connecting link and the operating shaft downwardly and upwardly, and an operating link pivotally connected at one end to each shell section and having its opposite end pivotally connected to the operating shaft whereby upward and downward movement of the operating shaft swings the shell sections between their open and closed positions.

2. An attachment as claimed in claim 1 wherein the pivotal connection of each clam shell section confines the section to rotation about a first pivot axis extending transversely relative to the digger frame, the pivotal connection of each operating link to its shell section confines the operating link to rotation about a second pivot axis parallel to said first pivot axis and the pivotal connection of each operating link to the operating shaft confines the rotation of the operating link relative to the operating shaft to a pivot axis parallel to said first and second pivot axis.

3. An attachment as claimed in claim 2 wherein the operating links have points of pivotal connection to the operating shaft which are spaced transversely from and are on opposite sides of an axis running from the pivotal connection between the operating shaft and the connecting link to the region at the lower end of the digger frame where the shell sections are pivotally connected.

4. An attachment as claimed in claim 3 wherein said operating links cross over one another intermediate their lengths.

5. An attachment as claimed in claim 3 wherein the digger frame has an upper section connected to the attachment frame, a lower section connected to the shell sections and a vertical swivel means between its upper and lower sections, and the operating shaft has an upper section connected to the connecting link, a lower section connected to the operating links and a vertical swivel means between its upper and lower sections.

6. An attachment as claimed in claim 1 including guide means between the operating shaft and the digger frame for guiding the shaft to move longitudinally relative to the frame.

7. An attachment as claimed in claim 1 wherein the pivotal connection between the digger and attachment frames confines their relative movement to rotation about an axis extending transversely of the digger frame.

8. An attachment as claimed in claim 1 wherein one of said pivotal connections between the operating shaft, connecting link and rocking lever comprises a universal joint.

9. An attachment as claimed in claim 8 wherein the pivotal connection between the operating shaft and the connecting link comprises a universal joint.

10. An attachment as claimed in claim 1 wherein the rocking lever has its pivotal connection to the connecting link at an end adjacent the digger frame, and its pivotal connection to the attachment frame spaced between its pivotal connection to the connecting link and said coupling point.

11. An attachment as claimed in claim 1 wherein the attachment frame has two spaced fastening points adapted to receive fasteners for attaching it to the dipper stick.

12. An attachment as claimed in claim 11 wherein the attachment frame comprises two plates adapted to be clamped on opposite sides of the dipper stick and having at one end at least one pivot pin extending transversely of the plates and constituting the pivotal connection to the digger frame.

13. An attachment as claimed in claim 12 including a reinforcing yoke piece extending between said plates adjacent the pivot pin.

14. An attachment as claimed in claim 1 in which each clam shell section defines a lip spaced from the point of pivotal connection to the digger frame and said lip has a set of teeth protruding from the lip.

15. An attachment as claimed in claim 14 in which each shell section has an arcuate outer side and the outer face of said set of teeth conforming to a plane substantially tangential to said arcuate outer face.

* * * * *